United States Patent [19]

Rand

[11] 4,101,340

[45] Jul. 18, 1978

[54] SOLVENT SPRAY CLEANING SYSTEM FOR MINIMIZING SOLVENT LOSSES

[75] Inventor: Burton Rand, Center Square, Pa.

[73] Assignee: Autosonics, Inc., Norristown, Pa.

[21] Appl. No.: 777,820

[22] Filed: Mar. 15, 1977

Related U.S. Application Data

[63] Continuation-in-part of Ser. No. 662,750, Mar. 1, 1976, Pat. No. 4,029,517.

[51] Int. Cl.[2] ..... B08B 3/08

[52] U.S. Cl. ..... 134/11; 134/12; 134/31; 134/40; 134/105; 134/109; 134/135

[58] Field of Search ..... 134/11, 12, 31, 35, 134/40, 105, 109, 135; 68/18 C; 34/73; 202/170

[56] References Cited

U.S. PATENT DOCUMENTS

| | | | |
|---|---|---|---|
| 2,091,182 | 8/1937 | Mitchell | 202/170 |
| 2,371,394 | 3/1945 | Hunter et al. | 202/170 |
| 2,385,564 | 9/1945 | Booth et al. | 202/170 X |
| 3,424,177 | 1/1969 | Hamilton | 134/11 X |
| 3,460,990 | 8/1969 | Barday | 134/31 |
| 3,772,082 | 11/1973 | Dunn | 134/11 X |
| 4,029,517 | 6/1977 | Rand | 134/11 |

*Primary Examiner*—S. Leon Bashore
*Assistant Examiner*—Marc L. Caroff
*Attorney, Agent, or Firm*—Seidel, Gonda & Goldhammer

[57] ABSTRACT

Product cleaning apparatus having a treatment chamber provided with unheated spray cleaning zone and a sump separated by a wall and a closure member which cooperates with the wall so that the spray cleaning zone may be isolated from the sump. During such isolation of the sump and the spray cleaning zone, solvent vapors are removed to thereby facilitate introduction or removal of work into the chamber while minimizing solvent losses to the atmosphere and minimizing exposure of workers to solvent vapors.

10 Claims, 1 Drawing Figure

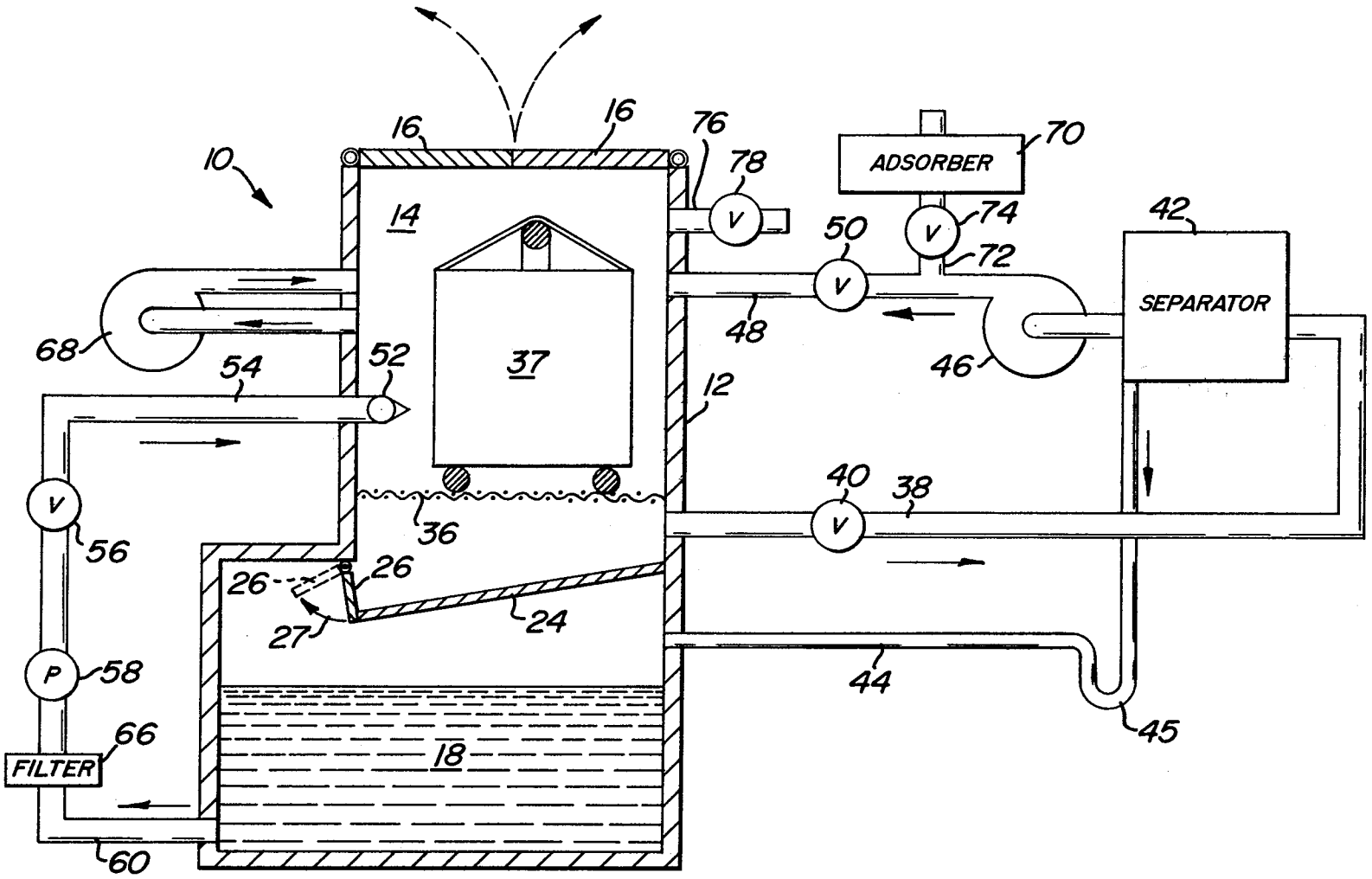
SEPARATOR
ADSORBER
FILTER
V
P
10
12
14
16
18
24
26
27
36
37
38
40
42
44
45
46
48
50
52
54
56
58
60
66
68
70
72
74
76
78

SOLVENT SPRAY CLEANING SYSTEM FOR MINIMIZING SOLVENT LOSSES

RELATED CASE

This application is a continuation-in-part of my copending Application Ser. No. 662,750 filed Mar. 1, 1976, now U.S. Pat. No. 4,029,517, for Vapor Degreasing System Having A Divider Wall Between Upper and Lower Vapor Zone Portions.

BACKGROUND

A large number of patents have issued directed to cleaning apparatus and degreaser tanks. For example, see my U.S. Pat. Nos. 3,375,177; 3,078,701 and 3,049,904.

Loss of vapor is a pollution hazard to operating personnel as well as being an economic loss. Regardless of whether the apparatus has a cover or is open, there is a loss of vapor when the things being cleaned are removed from within the treatment chamber due to solvent in the form of vapor or liquid which adheres thereto. The present invention seeks to minimize vapor losses by a structural interrelationship of the components of the cleaning apparatus.

SUMMARY OF INVENTION

The cleaning apparatus of the present invention preferably takes the form of an apparatus comprising a housing adapted to have a cleaning zone and a solvent sump in the housing. The housing is provided with a wall dividing the sump from the cleaning zone.

A means is provided within the housing for cooperation with a portion of the dividing wall to thereby provide selective communication between the sump and the cleaning zone in the treatment chamber. A means is provided in the cleaning zone above the wall for supporting work within the zone. A means is provided in connection with said zone for separating vaporized solvent from air.

The separating means has an inlet connected by a first conduit means with the cleaning zone. An outlet of the separating means communicates with the cleaning zone by way of a second conduit means. A means such as a blower selectively causes circulation of air and vaporized solvent from the cleaning zone through the first conduit means to the separating means which discharges desaturated air to the cleaning zone through the second conduit means.

The separating means is preferably in an inoperative of idling state until it is desired to remove work from the zone. The sump and the cleaning zone are isolated from one another prior to circulation of vapor and air from the cleaning zone through the separating means.

It is an object of the present invention to provide a novel cleaning apparatus and method for minimizing loss of vaporizable solvent.

It is another object of the present invention to provide cleaning apparatus and method which is simple and reliable.

Other objects will appear hereinafter.

The drawing illustrates schematically a cleaning apparatus in accordance with the present-invention. It is noted that the drawing does not include condensers in the vessel.

Referring to the drawing in detail, wherein like numerals indicate like elements, there is shown a cleaning apparatus in accordance with the present invention designated generally as 10.

The apparatus 10 includes a vessel 12 having a treatment chamber 14. The vessel 12 adjacent the upper end may be provided with one or more covers 16. As illustrated, each of the covers 16 is pivotably supported and adapted to overlie one half of the upper end of the treatment chamber 14. If desired, the cover may be a one piece cover slideably supported by vessel 12 for movement between open and closed positions.

Within the vessel 12, chamber 14 defines a cleaning zone isolated from sump 18 by a divider wall 24. The divider wall 24 is preferably sloped as illustrated so as to facilitate drainage of spent spray. A movable closure member 26 is supported by the housing. Closure member 26 is adapted to be rotated manually in the direction of arrow 27 from the closed position illustrated to an open position whereby sump 18 is in open communication with the cleaning zone in treatment chamber 14.

Above the wall 24, the chamber 14 is provided with any suitable support means such as the work support 36 on which can be supported the work 37. Suitable reinforcing structure may be provided for the work support 36 so that it may support the load of the work 37. The cover 16 preferably can be moved to an open disposition so that work 37, such as a rack of parts to be cleaned, may be introduced or removed from the chamber 14 by a hoist. Work 37 may be clothing to be dry cleaned or tightly packed small parts such as nails, or machined or cast assemblies, etc. The covers 16 are shown in a closed position but when open, the complete upper end of the chamber 14 is exposed and available for introduction or removal of the work 37.

A first conduit 38 having a valve 40 has one end connected to the chamber 14 above the elevation of the wall 24 so as to preferaby communicate with the lower end of the chamber 14. The other end of conduit 38 is connected to the inlet of a separating means 42. Separating means 42 is preferably a chiller, adsorber, or other device for separating air from solvent vapors. Condensed solvent is transmitted from the separating means 42 by gravity to the sump 18 by way of conduit 44 containing a trap 45.

The outlet of the separating means 42 communicates with the inlet of a blower 46. The outlet of the blower 46 preferably communicates with the upper portion of the chamber 14 by way of a second conduit 48 having valve 50.

Solvent is introduced into chamber 14 by way of nozzles 52 (only one shown) connected to one end of conduit 54 containing valve 56. The other end of conduit 54 is connected to the discharge side of pump 58. The inlet side of pump 58 communicates with the lower end of sump 18 by way of conduit 60. A filter 66 may be provided in conduit 60. A blower 68 is provided on vessel 12 for creating turbulence in chamber 14 by way of inlet and outlet conduits communicating therewith. Such turbulence removes vapors adhered to work 37.

The solvent may be heated by way of a heater in conduit 54. The solvent may be of the type that vaporizes at room temperature whereby a cooling coil may be provided in conduit 54 and/or sump 18.

The solvent is preferably a halogenated solvent such as trichlorethylene, methylene chloride, Freon, etc., or naptha or alcohols and mixtures thereof. Cleaning of work 37 is by contact with the solvent and the force of the sprayed solvent. Since these preferred solvents need not be heated, there is an economic saving.

An adsorber 70 containing carbon or the like is connected to conduit 48 upstream of valve 50 by way of conduit 72 containing valve 74. The outlet side of adsorber 70 communicates with the atmosphere. A short conduit 76 containing valve 78 is connected to chamber 14 for introducing ambient air thereinto.

A typical manner in which the apparatus 10 may be used is as follows. Work 37 is lowered into the chamber 14 by a hoist or the like. The covers 16 are then closed. Closure member 26 is manipulated to its open position shown in phantom. Solvent is sprayed from nozzles 52 onto work 37. The spent spray flows into sump 18 and is recirculated to nozzles 52 by pump 58.

After the work 37 has been subjected to the sprays for a sufficient period of time, pump 58 is shut off and closure member 26 is moved to a closed position as shown thereby isolating the chamber 14 from fluid communication with the sump 18. Thereafter, valves 40 and 50 are opened and the blowers 46 and 68 are started for simultaneous operation. Valves 56, 74, 78 are closed.

If it is desired to soak work 37 in the solvent, the above sequence is followed but with member 26 left in its closed position. Before removal of solvent from chamber 14, member 26 is moved to its phantom position, the solvent then flows into sump 18, and then member 26 is moved to its closed position.

A mixture of residual vaporized solvent and air flows from the chamber 14 through conduit 38 to the separating means 42. The separating means 42 separates the mixture into desaturated air and liquid solvent. The liquid solvent drains by way of conduit 44 to the sump 18. Counter flow is prevented by trap 45. The blower 46 returns the desaturated air preferably to the upper portion of the chamber 14 by way of conduit 48. A drying effect on the work 37 to remove residual vapors thereon is attained by blower 68 which creates turbulence in said chamber 14. After a predetermined period of time which varies with the size and nature of the work being cleaned, the chamber 14 and the work 37 are essentially devoid of solvent vapors. Blowers 46 and 68 are turned off. Thereafter, the cover 16 may be opened and the load 37 removed by the hoist or the like. It will be noted that during the circulation of air and vapors from the chamber 14, the chamber 14 is isolated from the sump 18 by way of wall 24 and closure member 26.

The efficiency of the system is improved if the method used includes the following steps. When most of the vapors have been removed by separator 42, valve 50 is closed and valves 74, 78 are opened. Air and any vapor discharged from blower 46 is introduced into adsorber 70 which removes the vapor. The air is then discharged from adsorber 70 to the atmosphere. Ambient air enters chamber 14 by way of conduit 76 to increase the air temperature in chamber 14 and decrease the relative humidity therein.

If desired, one or both of the mating faces of the covers 16 may be provided with a deformable portion to embrace a hoist chain or strap. In that event, work 37 may be suspended from the hoist while in chamber 14 and yet the covers 16 may be moved to a closed disposition.

The present invention may be embodied in other specific forms without departing from the spirit or essential attributes thereof and, accordingly, reference should be made to the appended claims, rather than to the foregoing specification as indicating the scope of the invention.

I claim:

1. Cleaning apparatus comprising a vessel having a treatment chamber and an unheated sump, said vessel being free from condenser means capable of defining an upper limit of a vapor zone in said chamber, door means for selectively closing the upper end of said chamber, means for selectively providing fluid communication between said chamber and sump so that solvent may flow from said chamber to said sump and for selectively isolating said chamber from fluid communication with said sump, means for supporting work to be cleaned in said chamber, means connected to said chamber for introducing solvent directly into said chamber, means for separating vaporized solvent from air, said separating means having an inlet and an outlet, first conduit means providing communication between said treatment chamber and said inlet of said separating means, second conduit means extending from the outlet of said separating means to said chamber, means for selectively causing circulation of air and any vaporized solvent in said chamber to flow through said first conduit means to said separating means and for discharging desaturated air to the chamber by way of said second conduit means while said chamber is isolated from fluid communication with said sump and while said door means closes the upper end of said chamber.

2. Apparatus in accordance with claim 1 wherein said means for introducing solvent into said chamber includes a pump communicating on its suction side with said sump so that unheated liquified solvent from said sump may be recirculated to said treatment chamber.

3. Apparatus in accordance with claim 1 wherein said means for isolating said chamber and sump includes a sloping wall in said vessel and a cooperating movable closure member.

4. Apparatus in accordance with claim 1 wherein said means for introducing solvent into said chamber includes at least one nozzle positioned directly into said chamber.

5. Apparatus in accordance with claim 1 including an adsorber having its inlet connected to said second conduit means, valve means for selectively diverting discharge from said separating means through said adsorber, said separating means being a chiller, and means for selectively introducing ambient air into said chamber when discharge from the chiller is diverted to said adsorber.

6. Apparatus in accordance with claim 1 including a blower separate from said circulation means for recirculating air in said chamber for creating turbulence in said chamber when said chamber is isolated from fluid communication with said sump.

7. Cleaning apparatus comprising a vessel having a treatment chamber and a sump, means for selectively providing fluid communication for liquid solvents between said chamber and sump and for selectively isolating said chamber from fluid communication with said sump, means for supporting work to be cleaned in said chamber, means having at least one nozzle in said chamber for spraying solvent directly into said chamber, a pump connected to said conduit means and communicating on its suction side with said sump so that liquified solvent from said sump may be recirculated to said nozzle, means for separating vaporized solvent from air, said separating means having an inlet and an outlet, first conduit means providing communication between said treatment chamber and said inlet of said separating means, second conduit means extending from the outlet of said separating means to said chamber, means for selectively causing circulation of air and vaporized solvent from said chamber through said first conduit means to said separating means and for discharging desaturated air to the chamber by way of said second conduit means while said chamber is isolated from said sump, a blower for removing air directly from and returning air directly to said chamber for creating turbulence in said chamber when said chamber is isolated from said sump, means connected to said second conduit means for selectively diverting air flow to atmosphere, and means for warming the temperature of air in said chamber when air is diverted from said second conduit means to atmosphere.

8. A method of cleaning work comprising:

(a) introducing work to be cleaned into a treating chamber of a vessel, said vessel having an unheated sump selectively communicating with the bottom of said chamber by way of a flow passage, closing the upper end of said chamber, closing said flow passage, (b) introducing liquid solvent into said chamber by way of at least one nozzle in said chamber, said step of introducing solvent into said chamber including pumping unheated solvent from said sump to said nozzle, cleaning said work by contact with said solvent and any vapors of the solvent generated in said chamber, (c) opening said flow passage and discharging liquid solvent from said chamber into said sump, (d) isolating said chamber from fluid communication with said sump after said discharging step and then removing residual solvent vapors from said chamber and said work while maintaining the upper end of the chamber closed, said removing step including liquifying said vapors while creating turbulence in said chamber, (e) opening the upper end of said chamber and then removing said work from said chamber.

9. A method in accordance with claim 8 including introducing solvent into said chamber at substantially ambient temperature.

10. A method in accordance with claim 8 including performing the following between steps (d) and (e):

(f) raising the temperature in said chamber by introducing ambient air thereinto.

* * * * *